US011226174B1

(12) United States Patent
Chen

(10) Patent No.: US 11,226,174 B1
(45) Date of Patent: Jan. 18, 2022

(54) SIGHT ADJUSTER

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/467,420

(22) Filed: Sep. 6, 2021

Related U.S. Application Data

(63) Continuation-in-part of application No. 17/233,576, filed on Apr. 19, 2021.

(51) Int. Cl.
*F41G 1/54* (2006.01)

(52) U.S. Cl.
CPC ..... *F41G 1/545* (2013.01)

(58) Field of Classification Search
CPC ..... F41G 1/54; F41G 1/545; F41C 3/00
USPC ..... 42/90, 108
See application file for complete search history.

(56) References Cited

U.S. PATENT DOCUMENTS

| | | | | | |
|---|---|---|---|---|---|
| 5,864,957 | A * | 2/1999 | Small | F41G 1/54 | 42/111 |
| D622,807 | S * | 8/2010 | Stone | D22/199 | |
| D675,698 | S * | 2/2013 | Bietsch | D22/108 | |
| 9,784,535 | B1 * | 10/2017 | Cheng | F41G 1/545 | |
| D904,548 | S * | 12/2020 | Chen | D22/108 | |
| 10,955,219 | B1 * | 3/2021 | Morris | F41G 1/26 | |
| 2011/0167702 | A1 * | 7/2011 | Bietsch | F41G 1/545 | 42/90 |
| 2011/0252688 | A1 * | 10/2011 | Bietsch | F41G 1/545 | 42/90 |
| 2013/0255128 | A1 * | 10/2013 | Fisher | F41G 1/545 | 42/108 |
| 2020/0400407 | A1 * | 12/2020 | LoRocco | F41G 1/545 | |

* cited by examiner

*Primary Examiner* — Samir Abdosh

(57) ABSTRACT

The present disclosure provides a sight adjuster. The sight adjuster includes a frame, a horizontal clamping mechanism disposed on the frame, a vertical clamping mechanism disposed on the frame, and an adjusting mechanism disposed on the frame. The vertical clamping mechanism includes an upper fixing portion and a lower fixing portion. The lower fixing portion is disposed on a bottom portion of the frame. The lower fixing portion includes a lower driving piece, a support board and a bracket hinged to the support board. The lower driving piece drives the bracket to move along a vertical direction.

20 Claims, 6 Drawing Sheets

SIGHT ADJUSTER

CROSS REFERENCE TO RELATED APPLICATIONS

The present application is a continuation-in-part of a U.S. application Ser. No. 17/233,576, filed on Apr. 19, 2021, and the entire contents of which are hereby incorporated by reference in its entirety.

TECHNICAL FIELD

The present disclosure relates to a field of auxiliary tools technology for guns, and in particular to a sight adjuster.

BACKGROUND

A mechanical sight (usually a spy sight) on a pistol is connected to a barrel of the pistol by a guiding rail. Since the mechanical sight is able to be displaced along the guiding rail, a sight adjuster is needed to adjust a position of the mechanical sight relative to the barrel.

U.S. Pat. No. 9,784,535 discloses a sight adjustment tool, which includes a frame, horizontal clamping mechanisms, a vertical clamping mechanism, and an adjusting mechanism. The horizontal clamping mechanisms are located on both sides of the barrel and can be adjusted freely. A horizontal disc with threads disposed on a lower portion is disposed under the vertical clamping mechanism. A height of the horizontal disc is adjusted by screwing in and out of the threads on the lower portion to clamp the barrel in a vertical direction. The disadvantage of this type of sight adjuster is that there is only one fulcrum of the bottom horizontal disc, and whether the horizontal disc can be kept horizontal depends entirely on the accuracy and angle of the threads. Further, the horizontal clamping mechanisms require a user to adjust a position from both ends.

SUMMARY

The technical problem to be solved by the present disclosure is to provide a sight adjuster. The sight adjuster overcomes defects such as an operation of the horizontal clamping mechanism is time-consuming and laborious and the single fulcrum of the vertical clamping mechanism is unstable.

The present disclosure provides a sight adjuster. The sight adjuster comprises a frame, a horizontal clamping mechanism disposed on the frame, a vertical clamping mechanism disposed on the frame, and an adjusting mechanism disposed on the frame. The vertical clamping mechanism comprises an upper fixing portion and a lower fixing portion. The lower fixing portion is disposed on a bottom portion of the frame. The lower fixing portion comprises a lower driving piece, a support board and a bracket hinged to the support board. The lower driving piece drives the bracket to move along a vertical direction.

Furthermore, the bracket comprises first supporting plates and second supporting plates. Each first supporting plate and a corresponding second supporting plate are pinned together. A first stressed end of each first supporting plate is hinged to one side of the support board. A first supporting end of each first supporting plate abuts against an upper surface of the bottom portion of the frame. A second stressed end of each second supporting plate and the first stressed end of each first supporting plate are hinged to the bottom portion of the frame on a same side of the frame. A second supporting end of each second supporting plate abuts against the other side of the support board.

Furthermore, two ends of each first supporting plate and two ends of each second supporting plate comprise cambered surfaces. The cambered surfaces abut against the support board and the bottom portion of the frame.

Furthermore, the horizontal clamping mechanism comprises a horizontal driving portion, a horizontal sliding block, and a horizontal guiding portion. The horizontal guiding portion is slidably connected with the horizontal sliding block. T The horizontal driving portion is connected with the horizontal sliding block. The horizontal driving portion drives the horizontal sliding block to move, and the horizontal sliding block moves along a horizontal direction under guidance of the horizontal guiding portion.

Furthermore, the horizontal sliding block comprises a sliding groove. The horizontal guiding portion comprises an outer surface matching an inner surface of the sliding groove, so that the horizontal sliding block slides with respect to the horizontal guiding portion.

Furthermore, the horizontal sliding block further comprises a horizontal groove, so that there is a gap between the horizontal sliding block and the horizontal guiding portion.

Furthermore, the frame further comprises a first side frame and a second side frame. The second side frame comprises an inner surface. The horizontal sliding comprises an abutting surface. The inner surface of the second side frame and the abutting surface of the horizontal sliding block are arranged in parallel Furthermore, the frame further comprises a first side frame and a second side frame. The sight adjuster further comprises a first gasket and a second gasket. The first gasket is connected to the second side frame. The second gasket is connected to the horizontal sliding block.

Furthermore, the second side frame comprises an inner surface. The horizontal sliding comprises an abutting surface. At least one first groove is disposed on the inner surface of the second side frame. At least one second groove is disposed on the abutting surface of the horizontal sliding block. At least one first locking column matching with the first groove is disposed on the first gasket. At least one second locking column matching with the at least one second groove is disposed on the second gasket. The at least one first groove is connected to the at least first locking column. The at least one second groove is connected to the at least one second locking column.

Furthermore, the adjusting mechanism comprises an adjustment guiding piece and an adjustment moving piece. The adjustment guiding piece is fixed on a lower surface of a top portion of the frame, and the adjustment moving piece is horizontal movable with respect to the adjustment guiding piece. The adjustment moving piece comprises a clamping portion. The clamping portion is configured to apply thrust to the sight in a horizontal direction.

Furthermore, the adjusting mechanism further comprises a driving handle configured to drive the adjustment moving piece. The driving handle is ratably connected with a side frame of the frame. The driving handle is movably connected with the adjustment moving piece.

Furthermore, the driving handle is connected with the adjusting moving piece through threads.

Furthermore, the upper fixing portion comprises an upper driving piece and an upper abutting piece. The upper driving piece is connected with the upper abutting piece. The upper driving piece drives the upper abutting piece to move in the vertical direction with respect to a top portion of the frame.

Compared with the prior art, the present disclosure has the advantage that the lower fixing portion of the vertical clamping mechanism adopts a multi-point support method, which is stable and conducive to maintaining a horizontal state. The horizontal clamping mechanism is able to be adjusted from only one side, which saves time and a user's energy, Moreover, a structure is simplified for easy processing.

DETAILED DESCRIPTION

Figure 1:
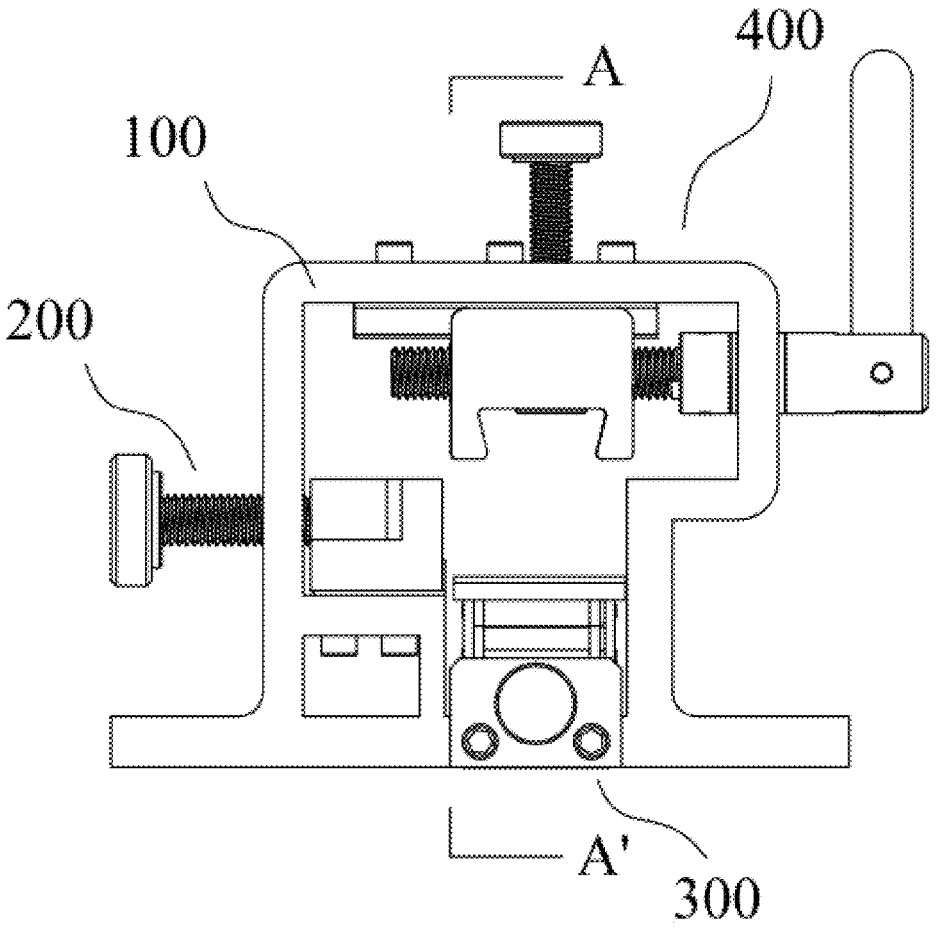
FIG. 1 is a front schematic diagram of a sight adjuster according to one embodiment of the present disclosure.
Figure 2:
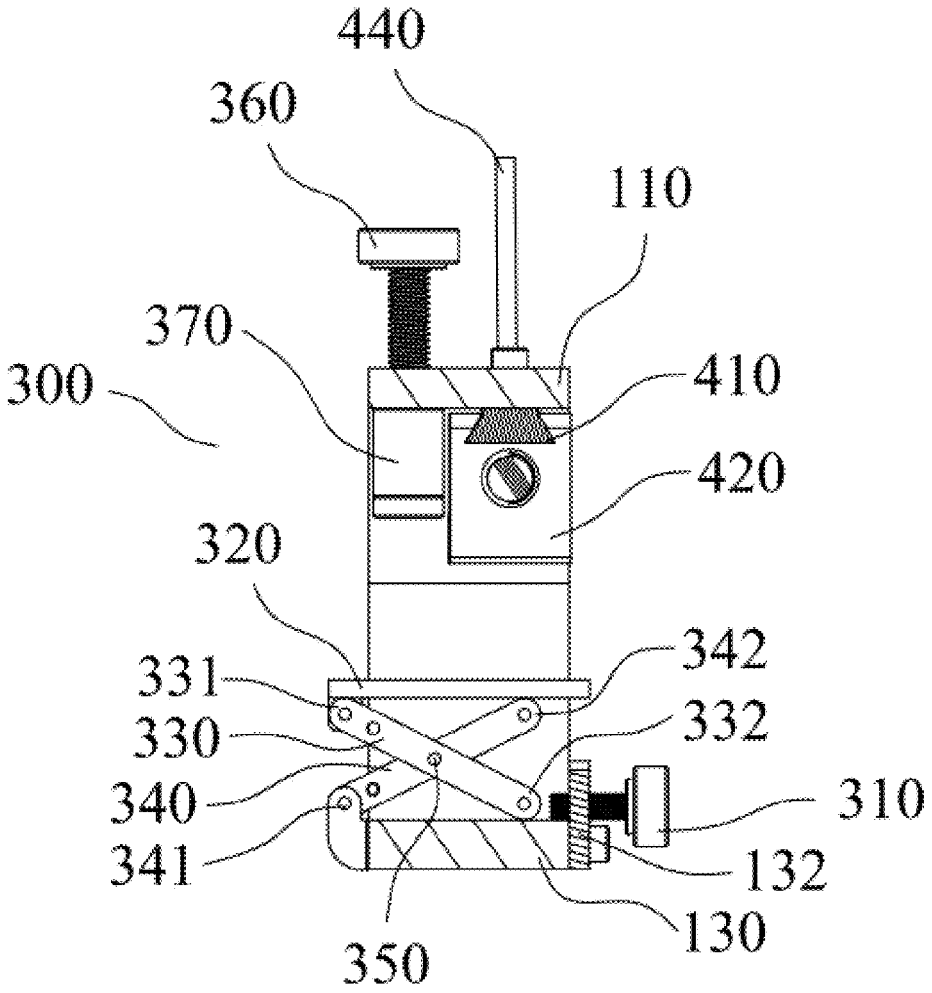
FIG. 2 is a cross-sectional view taken along the line A-A.
Figure 3:
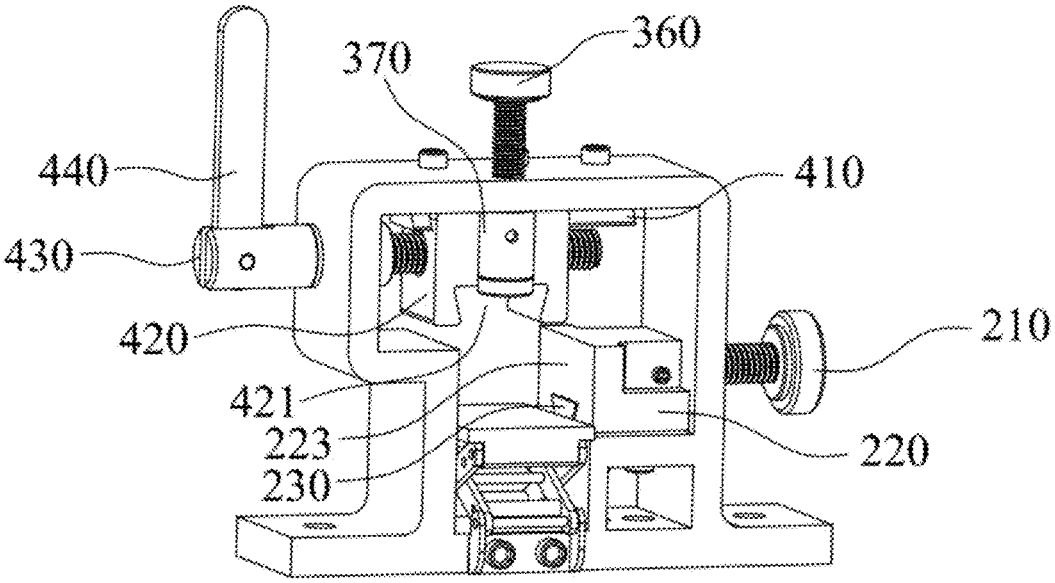
FIG. 3 is a schematic diagram showing a structure of the sight adjuster of the present disclosure.
Figure 4:
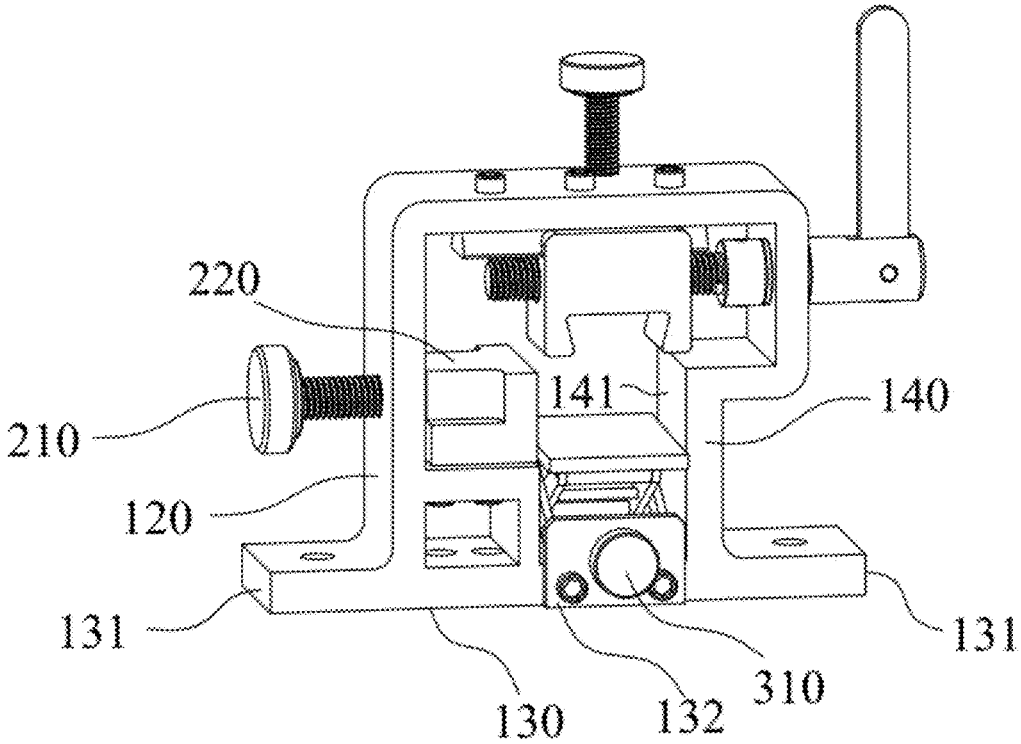
FIG. 4 is another schematic diagram showing the structure of the sight adjuster of the present disclosure.
Figure 5:
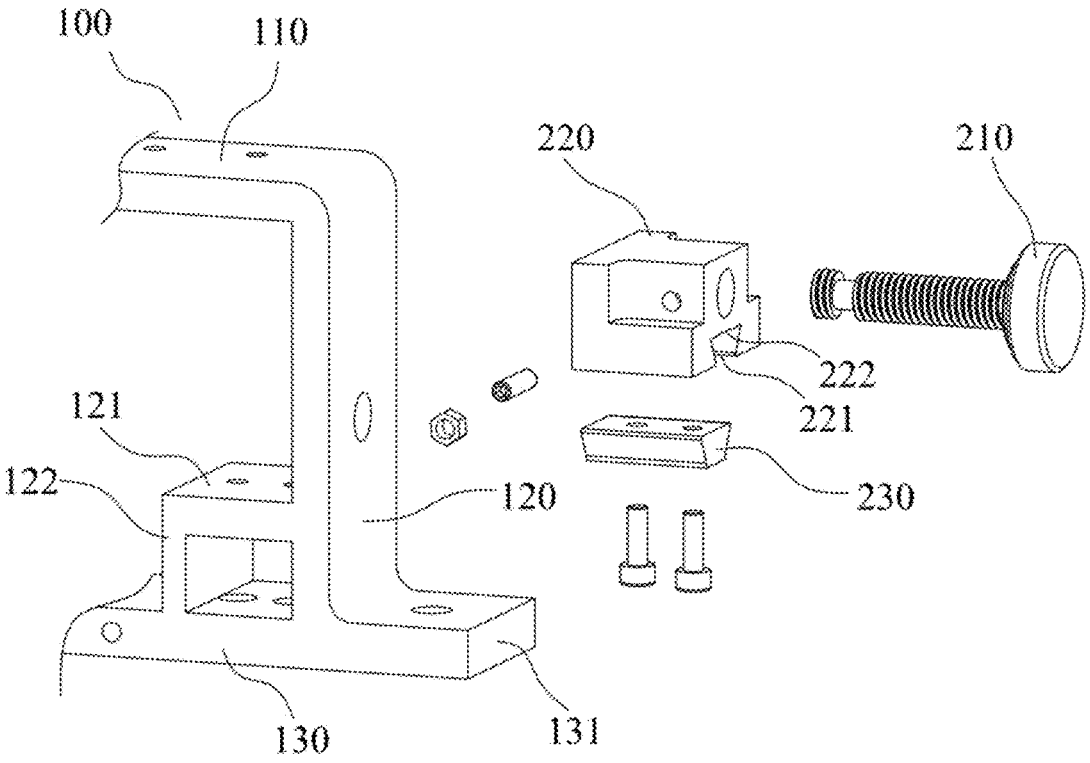
FIG. 5 is an exploded view of portions of the sight adjuster of the present disclosure.

The present disclosure will be further described in detail with reference to the embodiments and the drawings.

Embodiment 1

As shown in FIGS. 1-5, the present disclosure provides a sight adjuster. The sight adjuster comprises a frame 100, a horizontal clamping mechanism 200 connected with the frame 100, a vertical clamping mechanism 300 connected with the frame 100, and an adjusting mechanism 400 connected with the frame 100. The vertical clamping mechanism 300 comprises an upper fixing portion and a lower fixing portion. The frame 100 is an integral frame with a continuous closed structure. The frame 100 comprises a top portion 110, a first side frame 120, a bottom portion 130, and a second side frame 140. The top portion 110, the first side frame 120, the bottom portion 130, and the second side frame 140 are connected end to end in sequence. The adjusting mechanism 400 and the upper fixing portion of the vertical clamping mechanism 300 are disposed on the top portion 110 of the frame 100. The lower fixing portion of the vertical clamping mechanism 300 is disposed on the bottom portion of the frame 100. The bottom portion 130 comprises side wings 131 extending outward to improve overall stability of the sight adjuster. The first side frame 120 is configured to mount the horizontal clamping mechanism 200, and the second side frame 140 is configured to install the adjusting mechanism 400. If a center of gravity of the sight adjuster and a comfort of the user during operation are not taken into account, the horizontal clamping mechanism 200 and the adjusting mechanism 400 may be mounted on a same side frame at the same time (for example, they may be mounted on the first side frame 120 or mounted on the second side frame 140 at the same time). In one embodiment, the horizontal clamping mechanism 200 and the adjusting mechanism 400 are disposed on two opposite side frames, which is in favor of balancing the center of gravity of the overall sight adjuster and convenience of two-handed operation.

In order to adjust the sight on a barrel, a top portion of the barrel, a bottom portion of the barrel, and two sides of the barrel are fixed first. The horizontal clamping mechanism 200 is configured to clamp the two sides of the barrel. The upper fixing portion of the vertical clamping mechanism 300 and the lower fixing portion of the vertical clamping mechanism 300 are configured to clamp top and bottom surfaces of the barrel separately.

The horizontal clamping mechanism 200 comprises a horizontal driving portion 210, a horizontal sliding block 220, and a horizontal guiding portion 230. The horizontal guiding portion 230 is slidably connected with the horizontal sliding block 220. The horizontal driving portion 210 is connected with the horizontal sliding block 220. The horizontal driving portion 210 drives the horizontal sliding block 220 to move, and the horizontal sliding block 220 moves along a horizontal direction under guidance of the horizontal guiding portion 230. In one embodiment, the first side frame 120 comprises a horizontal extension platform 121 extending along the horizontal direction. The horizontal guiding portion 230 is fixedly connected to the horizontal extension platform 121. The horizontal sliding block 220 comprises a sliding groove 221. The horizontal guiding portion 230 comprises an outer surface matching an inner surface of the sliding groove 221, so that horizontal guiding portion 230 is sliceable relative to the sliding groove 221. Of course, the horizontal sliding block 220 and the horizontal guiding portion 230 can also be any other mechanisms that are able to cooperate with sliding or are able to perform relative movement, which are not limited thereto. The horizontal sliding block 220 further comprises a horizontal groove 222, so that there is a certain gap between the horizontal sliding block 220 and the horizontal guiding portion 230. Thus, in a process of relative movement of the horizontal sliding block 220 and horizontal guiding portion 230, the two will not hinder normal relative movement due to excessive friction. The horizontal sliding block 220 comprises an abutting surface 223. The abutting surface 223 of the horizontal sliding block 220 abuts on one side of the barrel, and the other side of the barrel abuts on an inner surface 141 of the second side frame 140. In one embodiment, the abutting surface 223 of the horizontal sliding block 220 and the inner surface 141 of the second side frame 140 are flat and parallel to each other.

The upper fixing portion of the vertical clamping mechanism 300 comprises an upper driving piece 360 and an upper abutting piece 370. The upper driving piece 360 is connected to the upper abutting piece 370. The upper driving piece 360 drives the upper abutting piece 370 to move in the vertical direction with respect to the top portion 110 of the frame 100. The upper abutting piece 370 comprise an upper abutting surface 371. When in use, the upper abutting surface 371 contacts a top surface of the barrel. In one embodiment, the upper driving piece 360 is connected with the top portion 110 through threads. The upper driving piece 360 is fixedly connected with the upper abutting piece 370. When in use, the upper driving piece 360 drives the upper abutting piece 370 and the top portion 110 to perform a relative displacement in the vertical direction. In other embodiments, the upper driving piece 360 may be movably connected to the upper abutting piece 370, as long as the upper abutting piece 370 and the top portion 110 are able to be relatively displaced in the vertical direction. In an extreme case, the upper abutment piece 370 comprises an upper driving portion, and the upper driving portion directly drives the upper abutting piece 370 and the top portion 110 to perform a relative movement in the vertical direction, and no additional upper driving piece 360 is required at this time.

The lower fixing portion of the vertical clamping mechanism 300 comprises a lower driving piece 310, a support board 320, and a bracket hinged to the support board 320. The lower driving piece 310 drives the bracket to move along the vertical direction. The bracket comprises first supporting plates 330 and second supporting plates 340. Each first supporting plate 330 and a corresponding second supporting plate 340 are pinned together via a pin 350. A first stressed end 331 of each first supporting plate 330 is hinged to one side of the support board 320. A first supporting end 332 of each first supporting plate 330 abuts against an upper surface of the bottom portion 130 of the frame 100. A second stressed end 341 of each second supporting plate 340 and the first stressed end 331 of a corresponding first supporting plate 330 are hinged to the bottom portion 130 of the frame on a same side of the frame 100. A second supporting end 342 of each second supporting plate 340 abuts against the other side of the support board 320. When the first supporting ends 332 receive horizontal thrust from the lower driving piece 310, the first supporting plates 330 rotate around the first stressed ends 331. Meanwhile, the first supporting plates 330 drive the second supporting plate 340 to rotate around the second stressed ends 341, so the second supporting ends 342 and the first stressed ends 331 simultaneously push the support board 320 to move upward. In the same way, when a vertical clamping state needs to be released, the lower driving piece 310 gradually releases pushing force on the first supporting ends 332. The first supporting ends 332 are under downward pressure of the support board 320 to reversely rotate around the first stressed ends 331 and simultaneously drive the second supporting plates 340 to reversely rotate around the second stressed ends 341. At this time, the second supporting ends 342, the first stressed ends 331, and the support board 320 move downward. The support board 320 comprises a lower abutting surface 321, and the lower abutting surface 321 abuts against a bottom surface of the barrel. Two ends of each first supporting plate 330 and two ends of each second supporting plate 340 comprise cambered surfaces. The cambered surfaces abut against the support board 320 and the bottom portion 130 of the frame 100, which facilitates rotation, reduce friction when the support board 320 moves upward and downward. Of course, other methods that can reduce friction are able to be used, such as setting pulleys, sliding rails, and the like.

In one embodiment, two first supporting plates 330 are symmetrically arranged and two second supporting plates 340 are symmetrically arranged. The first supporting plates 330 and the second supporting plates and are respectively located on two sides below the support board 320 to support the support board. The two opposite first supporting plates 330 and the two opposite second supporting plates 340 are connected by cross bars. The multiple cross bars further improve the stability of the support structure. A first stressed rod connecting the two first supporting ends 332 directly under thrust from the lower driving piece 310. In one embodiment, the lower driving piece 310 is movably connected to the bottom portion 130 of the frame 100. The bottom portion 130 comprises a lower driving fixing plate 132. The lower driving piece 310 is connected with the lower driving fixing plate 132 through threads. When the lower driving piece 310 is screwed in, the lower driving piece 310 applies a thrust to the first stressed rod 333, and the support board 320 is raised. When the lower driving piece 310 is unscrewed, the lower driving piece 310 reduces the thrust applied to the first stressed rod 333, and the support board 320 moves downward. The lower driving piece 310 and the bottom portion 130 may be movably connected by other methods that can apply thrust to the first stressed rod or the first supporting ends 332, such as a snap connection with multiple positioning points or a spring connection mechanism, which is not limited thereto.

The adjusting mechanism 400 is configured to adjust a relative position of the sight and the barrel. When the barrel is fixed, the adjusting mechanism 400 clamps the sight and drives the sight to move.

In one embodiment, the adjusting mechanism 400 comprises an adjustment guiding piece 410 and an adjustment moving piece 420. The adjustment guiding piece 410 is fixed on a lower surface of the top portion 110 of the frame 100. The adjustment moving piece 420 is horizontal movable with respect to the adjustment guiding piece 420. The adjustment moving piece 420 comprises a clamping portion 421. The clamping portion 421 is configured to apply thrust to the sight in the horizontal direction. In one embodiment, the clamping portion 421 is a groove, and the clamping portion 421 applies the thrust to both sides of the sight by two opposite side walls of the groove respectively. In other embodiments, the clamping portion 421 may also be other common structures capable of applying thrust to both sides of the sight, such as a structure having one or more pairs of clamping arms.

The adjusting mechanism 400 comprises a driving handle 430 configured to drive the adjustment moving piece 420. The driving handle 430 is connected to the frame 100. In one embodiment, the driving handle 430 is rotatably connected to the second side frame 140. The driving handle 430 is movably connected with the adjustment moving piece 420. In one embodiment, the driving handle 430 is connected with the adjustment moving piece 420 through threads. When the driving handle 430 rotates, the adjustment moving piece 420 moves along a thread axis to drive the sight to move to position the sight. A swing arm 440 is connected to the driving handle 430 to increase a force arm to reduce force required to rotate the driving handle 430. The driving handle 430 can also be connected to other labor-saving mechanism that increases the force arm, which will not be described herein.

When using the sight adjuster of the disclosure, the gun with the sight is placed on the lower abutting surface 321 of the support board 320, so that the bottom surface of the barrel and the lower abutting surface 321 are in close contact with each other. Then, the sight is roughly placed in the clamping portion 421 of the adjusting mechanism 400, and the lower driving piece 310 is screwed in so that the lower driving piece 310 pushes the bracket to raise the support board 320 until the top surface of the barrel abuts against the upper abutting surface 371 of the upper abutting piece 370 to complete fixing of the sight adjuster in the vertical direction. Then, the horizontal driving portion 210 is screwed in, so that the two sides of the barrel respectively abuts against the abutting surface 223 of the horizontal sliding block 220 and the inner surface 141 of the second side frame 140 to complete fixing of the sight adjuster in the horizontal direction. Thus, the barrel is fixed. Then the driving handle 430 is rotated to make the adjustment moving piece 420 drive the sight to the target position until the sight is positioned.

Embodiment 2

The structure of the sight adjuster in this embodiment is different from that in Embodiment 1 in that the sight adjuster further includes a first gasket 510 and a second gasket 520.

Figure 6:
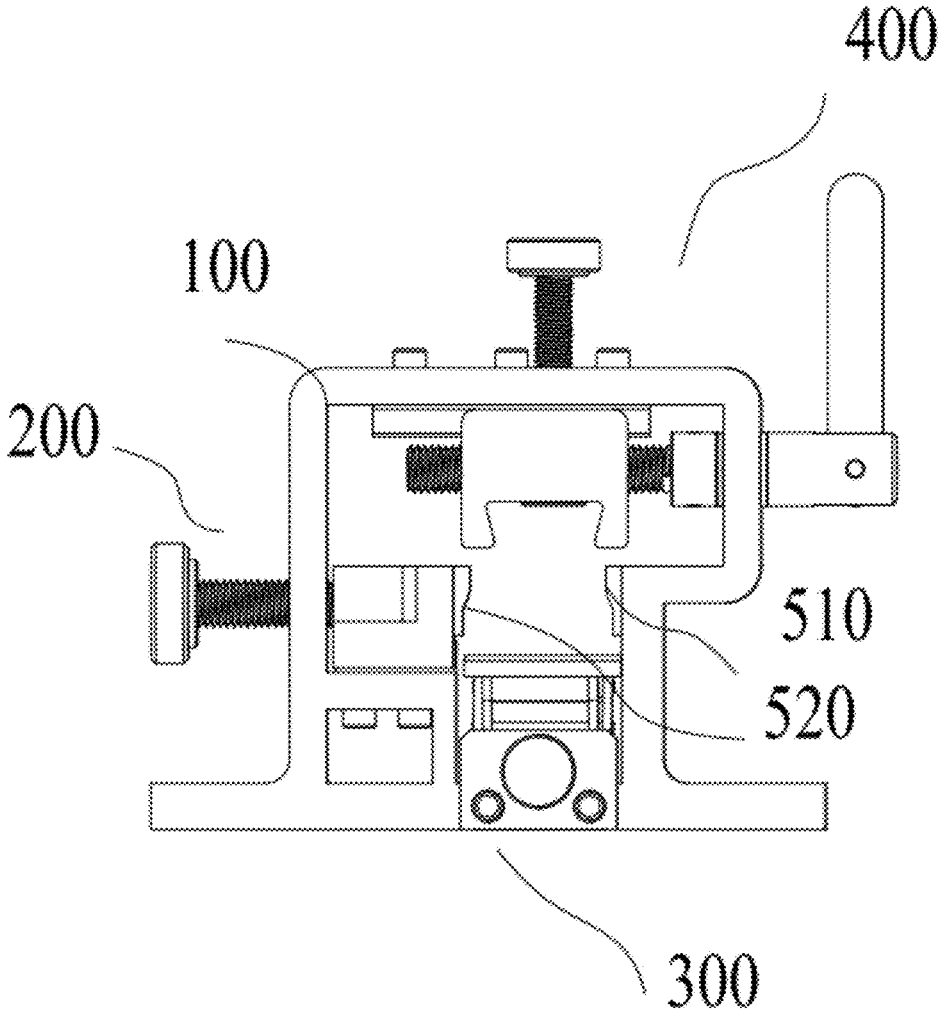
FIG. 6 is a front schematic diagram of a sight adjuster according to another embodiment of the present disclosure.
Figure 7:
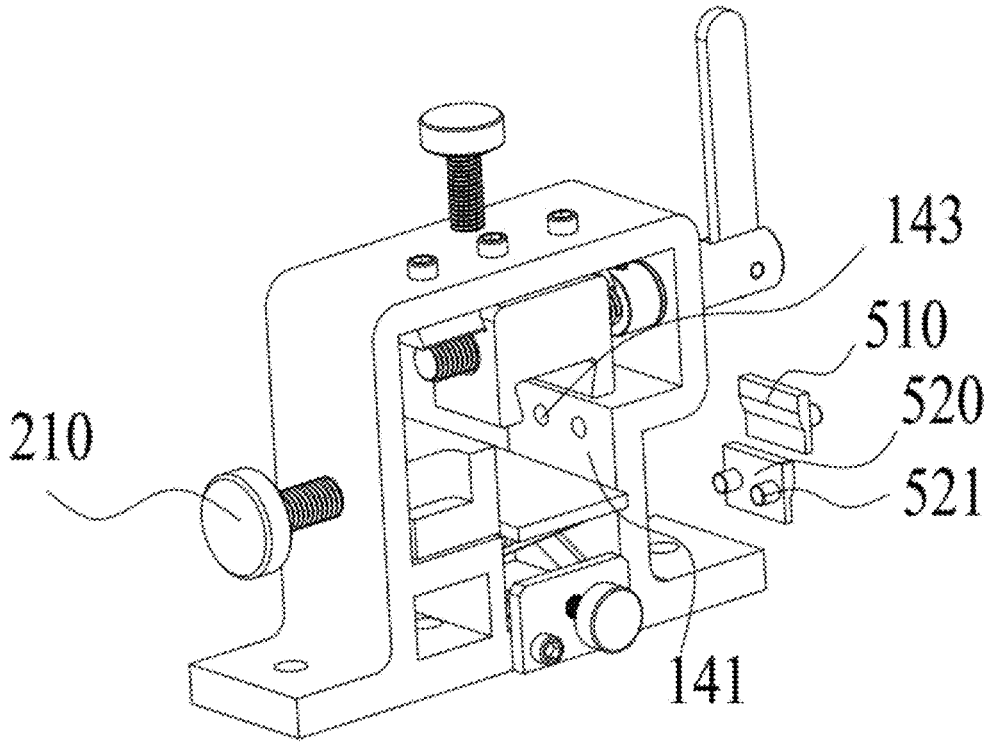
FIG. 7 is an exploded view of the sight adjuster according to another embodiment of the present disclosure.
Figure 8:
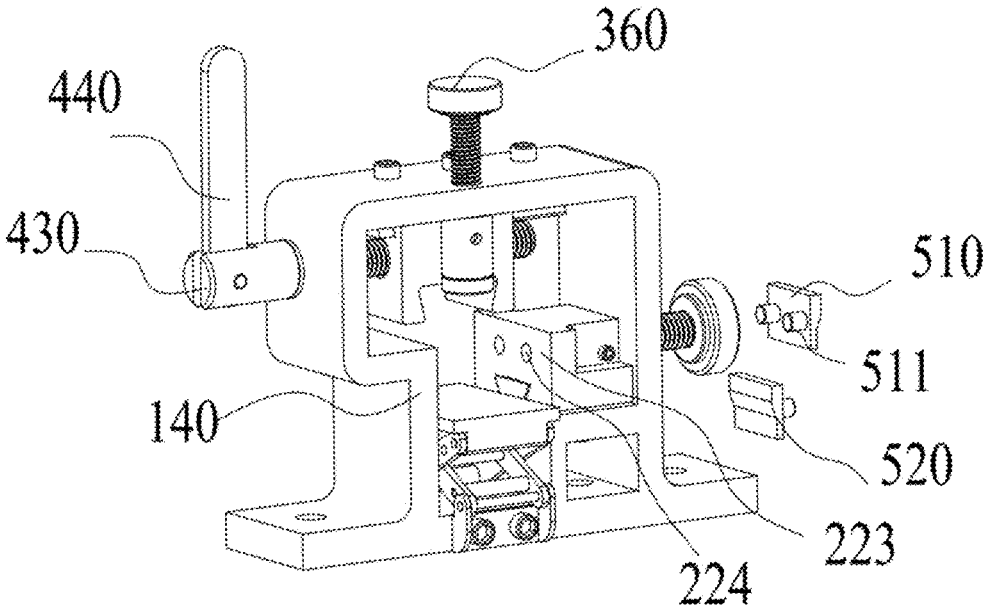
FIG. 8 is another exploded view of the sight adjuster according to another embodiment of the present disclosure.

As shown in FIGS. 6-8, the first gasket 510 is connected to the second side frame 140, and the second gasket 520 is connected to the horizontal sliding block 220. In one embodiment, the second side frame 140 comprises an inner surface 141, the horizontal sliding block 220 comprises an abutting surface 223. At least one first groove 143 is disposed on the inner surface 141 of the second side frame 140. At least one second groove 224 is disposed on the abutting surface 223 of the horizontal sliding block 220, At least one first locking column 511 matching with the first groove is 143 disposed on the first gasket 510. At least one second locking column 521 matching with the at least one second groove 224 is disposed on the second gasket 520. The at least one first groove 143 is connected to the at least first locking column 511, so that the first gasket 510 is fixed on the second side frame 140. The at least one second groove 224 is connected to the at least one second locking column 521, so that the second gasket 520 is fixed on the horizontal sliding block 220.

When using the sight adjuster of the disclosure, the gun with the sight is placed on the lower abutting surface 321 of the support board 320, so that the bottom surface of the barrel and the lower abutting surface 321 are in close contact with each other. Then, the sight is roughly placed in the clamping portion 421 of the adjusting mechanism 400, and the lower driving piece 310 is screwed in so that the lower driving piece 310 pushes the bracket to raise the support board 320 until the top surface of the barrel abuts against the upper abutting surface 371 of the upper abutting piece 370 to complete fixing of the sight adjuster in the vertical direction. Then, the horizontal driving portion 210 is screwed in, so that the two sides of the barrel respectively abuts against the first gasket 510 and the second gasket 520 to complete fixing of the sight adjuster in the horizontal direction. Thus, the barrel is fixed. Then the driving handle 430 is rotated to make the adjustment moving piece 420 drive the sight to the target position until the sight is positioned.

In the embodiment, the first gasket 510 and the second gasket 520 have a same structure, which is convenient for saving production costs. The first gasket 510 and the second gasket 520 are made of soft materials, such as sponge, silicon, etc., so the first gasket 510 and the second gasket 520 protect the barrel and at the same time buffer pressure on the barrel. Moreover, a shape of the first gasket 510 and a shape of the second gasket 520 can be adjusted correspondingly according to a shape of different barrels, which is not limited herein.

In the embodiment, both the number of the first grooves 143 and the number of the second grooves 224 are two. Of course, without affecting fixations of the first gasket 510 and the second gasket 520, the number of the first grooves 143 and the second grooves 224 can also be appropriately increased or decreased.

Of course, it should be understood that in another embodiment, the first grooves and the second grooves may also be respectively provided on the first gasket and the second gasket. The first locking columns may be extended outward from the second side frame, and the second locking columns may be extended outward from the horizontal sliding block, so that the fixations of the first gasket 510 and the second gasket 520 can also be achieved, which will not be descried herein.

The above content is a further detailed description of the present disclosure in conjunction with specific optional embodiments, and is not considered that the specific embodiments of the present disclosure are limited to these descriptions. For those of ordinary skill in the field to which the present disclosure belongs, a number of simple deductions or substitutions can be made without departing from the concept of the present disclosure, which should all be regarded as falling within the protection scope of the present disclosure.

What is claimed is:

1. A sight adjuster, comprising:

a frame;

a horizontal clamping mechanism disposed on the frame;

a vertical clamping mechanism disposed on the frame; and wherein the vertical clamping mechanism comprises an upper fixing portion and a lower fixing portion; the lower fixing portion is disposed on a bottom portion of the frame; the lower fixing portion comprises a lower driving piece, a support board, and a bracket hinged to the support board; the lower driving piece drives the bracket to move along a vertical direction.

2. The sight adjuster according to claim 1, wherein the bracket comprises first supporting plates and second supporting plates; each first supporting plate are pinned with a corresponding second supporting plate; a first stressed end of each first supporting plate is hinged to one side of the support board; a first supporting end of each first supporting plate abuts against an upper surface of the bottom portion of the frame; a second stressed end of each second supporting plate and the first stressed end of a corresponding first supporting plate are hinged to the bottom portion of the frame on a same side of the frame; a second supporting end of each second supporting plate abuts against the other side of the support board.

3. The sight adjuster according to claim 2, wherein two ends of each first supporting plate and two ends of each second supporting plate comprise cambered surfaces; the cambered surfaces abut against the support board and the bottom portion of the frame.

4. The sight adjuster according to claim 1, wherein the horizontal clamping mechanism comprises a horizontal driving portion, a horizontal sliding block, and a horizontal guiding portion; the horizontal guiding portion is slidably connected with the horizontal sliding block; the horizontal driving portion is connected with the horizontal sliding block; the horizontal driving portion drives the horizontal sliding block to move, and the horizontal sliding block moves along a horizontal direction under guidance of the horizontal guiding portion.

5. The sight adjuster according to claim 4, wherein the horizontal sliding block comprises a sliding groove; the horizontal guiding portion comprises an outer surface matching an inner surface of the sliding groove; so that the horizontal sliding block slides with respect to the horizontal guiding portion.

6. The sight adjuster according to claim 5, wherein the horizontal sliding block further comprises a horizontal groove, so that there is a gap between the horizontal sliding block and the horizontal guiding portion.

7. The sight adjuster according to claim 6, wherein the frame further comprises a first side frame and a second side frame; the second side frame comprises an inner surface; the horizontal sliding comprises an abutting surface; the inner surface of the second side frame and the abutting surface of the horizontal sliding block are arranged in parallel.

8. The sight adjuster according to claim 6, wherein the frame further comprises a first side frame and a second side frame; the sight adjuster further comprises a first gasket and a second gasket; the first gasket is connected to the second side frame; the second gasket is connected to the horizontal sliding block.

9. The sight adjuster according to claim 6, wherein the second side frame comprises an inner surface; the horizontal sliding comprises an abutting surface; at least one first groove is disposed on the inner surface of the second side frame, at least one second groove is disposed on the abutting surface of the horizontal sliding block; at least one first locking column matching with the first groove is disposed on the first gasket; at least one second locking column matching with the at least one second groove is disposed on the second gasket; the at least one first groove is connected to the at least first locking column; the at least one second groove is connected to the at least one second locking column.

10. The sight adjuster according to claim 1, wherein sight adjuster further comprises an adjusting mechanism disposed on the frame, the adjusting mechanism comprises an adjustment guiding piece and an adjustment moving piece; the adjustment guiding piece is fixed on a lower surface of a top portion of the frame; the adjustment moving piece is horizontal movable with respect to the adjustment guiding piece; the adjustment moving piece comprises a clamping portion; the clamping portion is configured to apply thrust to the sight in a horizontal direction.

11. The sight adjuster according to claim 10, wherein the adjusting mechanism further comprises a driving handle configured to drive the adjustment moving piece; the driving handle is ratably connected with a side frame of the frame; the driving handle is movably connected with the adjustment moving piece.

12. The sight adjuster according to claim 11, wherein the driving handle is connected with the adjusting moving piece through threads.

13. The sight adjuster according to claim 1, wherein the upper fixing portion comprises an upper driving piece and an upper abutting piece; the upper driving piece is connected with the upper abutting piece; the upper driving piece drives the upper abutting piece to move in the vertical direction with respect to a top portion of the frame.

14. A sight adjuster, comprising:

a frame;

a vertical clamping mechanism disposed on the frame; and wherein the vertical clamping mechanism comprises an upper fixing portion and a lower fixing portion; the lower fixing portion is disposed on a bottom portion of the frame; the lower fixing portion comprises a lower driving piece, a support board, and a bracket hinged to the support board; the lower driving piece drives the bracket to move along a vertical direction; and wherein the bracket comprises first supporting plates and second supporting plates; each first supporting plate are pinned with a corresponding second supporting plate; a first stressed end of each first supporting plate is hinged to one side of the support board; a first supporting end of each first supporting plate abuts against an upper surface of the bottom portion of the frame; a second stressed end of each second supporting plate and the first stressed end of a corresponding first supporting plate are hinged to the bottom portion of the frame on a same side of the frame; a second supporting end of each second supporting plate abuts against the other side of the support board.

15. The sight adjuster according to claim 14, wherein two ends of each first supporting plate and two ends of each second supporting plate comprise cambered surfaces; the cambered surfaces abut against the support board and the bottom portion of the frame.

16. The sight adjuster according to claim 14, wherein the sight adjuster further comprises a horizontal clamping mechanism disposed on the frame, the horizontal clamping mechanism comprises a horizontal driving portion, a horizontal sliding block, and a horizontal guiding portion; the horizontal guiding portion is slidably connected with the horizontal sliding block; the horizontal driving portion is connected with the horizontal sliding block; the horizontal driving portion drives the horizontal sliding block to move, and the horizontal sliding block moves along a horizontal direction under guidance of the horizontal guiding portion.

17. The sight adjuster according to claim 16, wherein the horizontal sliding block comprises a sliding groove; the horizontal guiding portion comprises an outer surface matching an inner surface of the sliding groove; so that the horizontal sliding block slides with respect to the horizontal guiding portion.

18. The sight adjuster according to claim 17, wherein the horizontal sliding block further comprises a horizontal groove, so that there is a gap between the horizontal sliding block and the horizontal guiding portion.

19. The sight adjuster according to claim 18, wherein the frame further comprises a first side frame and a second side frame; the second side frame comprises an inner surface; the horizontal sliding comprises an abutting surface; the inner surface of the second side frame and the abutting surface of the horizontal sliding block are arranged in parallel.

20. The sight adjuster according to claim 18, wherein the frame further comprises a first side frame and a second side frame; the sight adjuster further comprises a first gasket and a second gasket; the first gasket is connected to the second side frame; the second gasket is connected to the horizontal sliding block.

* * * * *